US012102133B2

(12) United States Patent
Zhao et al.

(10) Patent No.: US 12,102,133 B2
(45) Date of Patent: Oct. 1, 2024

(54) ELECTRONIC ATOMIZATION DEVICE AND METHOD FOR DETECTING INTAKE AMOUNT OF AEROSOL-FORMING MATRIX THEREOF

(71) Applicant: SHENZHEN SMOORE TECHNOLOGY LIMITED, Guangdong (CN)

(72) Inventors: Yihua Zhao, Shenzhen (CN); Weiming Fang, Shenzhen (CN); Jun Zhou, Shenzhen (CN); Zhenggen Dai, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 364 days.

(21) Appl. No.: 17/715,458

(22) Filed: Apr. 7, 2022

(65) Prior Publication Data

US 2022/0232899 A1 Jul. 28, 2022

Related U.S. Application Data

(63) Continuation of application No. PCT/CN2020/120194, filed on Oct. 10, 2020.

(30) Foreign Application Priority Data

Oct. 24, 2019 (CN) ..... 201911016902.3

(51) Int. Cl.

| | |
|---|---|
| ***A24F 40/53*** | (2020.01) |
| ***A24F 40/485*** | (2020.01) |
| ***A24F 40/51*** | (2020.01) |
| ***A24F 40/60*** | (2020.01) |

(52) U.S. Cl.

CPC ..... *A24F 40/53* (2020.01); *A24F 40/485* (2020.01); *A24F 40/51* (2020.01); *A24F 40/60* (2020.01)

(58) Field of Classification Search

CPC ..... A24F 40/53; A24F 40/485; A24F 40/51; A24F 40/60

See application file for complete search history.

(56) References Cited

U.S. PATENT DOCUMENTS 11,684,086 B2 * 6/2023 Lei ..... A24F 40/485 131/329
11,752,284 B2 * 9/2023 Dickens ..... H05B 1/0297 131/328

(Continued)

FOREIGN PATENT DOCUMENTS

CN 104010685 A 8/2014
CN 107427067 A 12/2017

(Continued)

OTHER PUBLICATIONS

Patent Cooperation Treaty, International Search Report, International Application No. PCT/CN2020/120194 (Jan. 13, 2021).

(Continued)

*Primary Examiner* — Truc T Nguyen
(74) *Attorney, Agent, or Firm* — Leydig, Voit & Mayer, Ltd.

(57) ABSTRACT

A detection method for detecting intake of an aerosol-forming substrate, applicable to an electronic vaporization device, includes: obtaining an air pressure value in an airflow channel of the electronic vaporization device, the airflow channel flowing vapor generated by the electronic vaporization device for ease of inhaling, the vapor being generated through vaporization of an aerosol-forming substrate in the electronic vaporization device; calculating intake of the aerosol-forming substrate according to the air pressure value; and reminding a user according to the intake, or adjusting operating parameters of the electronic vaporization device according to the intake.

10 Claims, 4 Drawing Sheets

(56) References Cited

U.S. PATENT DOCUMENTS

| | | | | |
|---|---|---|---|---|
| 11,785,988 | B2 * | 10/2023 | Lukan | A24F 40/60 131/329 |
| 2016/0143359 | A1 | 5/2016 | Xiang | |
| 2016/0360790 | A1 | 12/2016 | Calfee et al. | |
| 2017/0231284 | A1 * | 8/2017 | Newns | A24F 40/50 131/328 |
| 2018/0369519 | A1 | 12/2018 | Adelson | |
| 2023/0248074 | A1 * | 8/2023 | Moloney | A24F 40/60 131/328 |
| 2023/0263217 | A1 * | 8/2023 | Horowitz | A24F 40/44 131/328 |
| 2024/0245137 | A1 * | 7/2024 | Yamada | A24B 15/283 |

FOREIGN PATENT DOCUMENTS

| | | | |
|---|---|---|---|
| CN | 109480333 | A | 3/2019 |
| CN | 109491278 | A | 3/2019 |
| CN | 109619696 | A | 4/2019 |
| CN | 109875132 | A | 6/2019 |
| CN | 109924548 | A | 6/2019 |
| CN | 110209441 | A | 9/2019 |
| CN | 110839968 | A | 2/2020 |
| IN | 110279153 | A | 9/2019 |
| WO | 2018138750 | A1 | 8/2018 |

OTHER PUBLICATIONS

Patent Cooperation Treaty, Written Opinion of the International Searching Authority, International Application No. PCT/CN2020/120194 (Jan. 13, 2021).

Chinese Patent Office, First Office Action in Chinese Patent Application No. 201911016902.3 (Mar. 17, 2021).

Chinese Patent Office, Second Office Action in Chinese Patent Application No. 201911016902.3 (Sep. 9, 2021).

* cited by examiner

ELECTRONIC ATOMIZATION DEVICE AND METHOD FOR DETECTING INTAKE AMOUNT OF AEROSOL-FORMING MATRIX THEREOF

CROSS-REFERENCE TO PRIOR APPLICATION

This application is a continuation of International Patent Application No. PCT/CN2020/120194, filed on Oct. 10, 2020, which claims priority to Chinese Patent Application No. CN201911016902.3, filed on Oct. 24, 2019. The entire disclosure of both applications is hereby incorporated by reference herein.

FIELD

This application relates to the field of vaporization device technologies, and specifically, to an electronic vaporization device, a method for detecting intake of an aerosol-forming substrate, and a computer storage medium.

BACKGROUND

An electronic cigarette is also referred to as a virtual cigarette or an electronic vaporization device. As a cigarette substitute, the electronic cigarette is generally used for smoking cessation. The electronic cigarette includes appearance and taste similar to that of a cigarette, but generally does not include other harmful ingredients such as tar and suspended particulates in the cigarette.

As people pay more attention to health, people are also more concerned about intake of the electronic cigarette. However, in existing electronic cigarettes, there is basically no calculation and control over inhaling intake, or intake is merely calculated according to a use time, and the inhaling intake of a user cannot be accurately controlled.

SUMMARY

In an embodiment, the present invention provides a detection method for detecting intake of an aerosol-forming substrate, applicable to an electronic vaporization device, the detection method comprising: obtaining an air pressure value in an airflow channel of the electronic vaporization device, the airflow channel being configured to flow vapor generated by the electronic vaporization device for ease of inhaling, the vapor being generated through vaporization of an aerosol-forming substrate in the electronic vaporization device; calculating intake of the aerosol-forming substrate according to the air pressure value; and reminding a user according to the intake, or adjusting operating parameters of the electronic vaporization device according to the intake.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
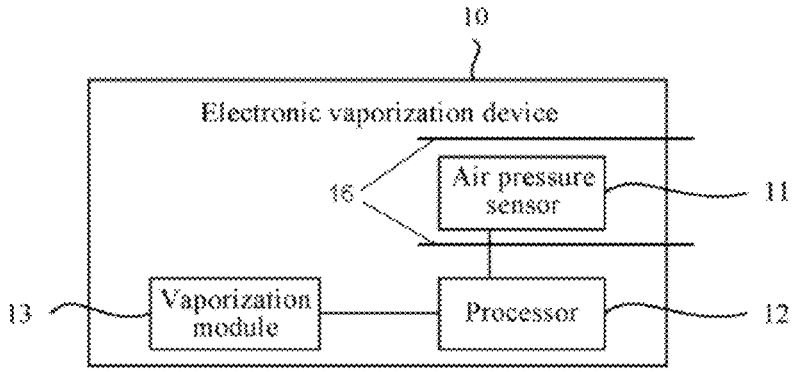
FIG. 1 is a schematic structural diagram of a first embodiment of an electronic vaporization device according to this application.

In an embodiment, the present invention provides an electronic vaporization device, a method for detecting intake of an aerosol-forming substrate, and a computer storage medium. As a result, the aerosol-forming substrate in the electronic vaporization device can be accurately detected, inhaling intake of a user can be controlled and the user may be reminded.

In an embodiment, the present invention provides a method for detecting intake of an aerosol-forming substrate, applicable to an electronic vaporization device, the detection method including: obtaining an air pressure value in an airflow channel of the electronic vaporization device, the airflow channel being configured for vapor generated by the electronic vaporization device to flow for ease of inhaling, the vapor being generated through vaporization of an aerosol-forming substrate in the electronic vaporization device; calculating intake of the aerosol-forming substrate according to the air pressure value; and reminding a user according to the intake, or adjusting operating parameters of the electronic vaporization device according to the intake.

Before the obtaining an air pressure value in an airflow channel of the electronic vaporization device, the method further includes: receiving a trigger instruction; and driving, in response to the trigger instruction, a vaporization module of the electronic vaporization device to work at a constant power or a constant temperature, to generate the vapor.

The obtaining an air pressure value in an airflow channel of the electronic vaporization device includes: obtaining at least one real-time air pressure value in the airflow channel of the electronic vaporization device within a set time period according to a set frequency; and calculating an air pressure difference value between the at least one real-time air pressure value and a standard atmospheric pressure, to obtain at least one air pressure difference value; calculating, when there is only one air pressure difference value, corresponding intake of the aerosol-forming substrate according to the air pressure difference value; or calculating, when there are at least two air pressure difference values, corresponding intake of the aerosol-forming substrate according to each air pressure difference value, and accumulating the intake of the aerosol-forming substrate corresponding to the at least two air pressure difference values, to obtain the intake of the aerosol-forming substrate within the set time period.

The calculating corresponding intake of the aerosol-forming substrate according to each air pressure difference value, and accumulating the intake of the aerosol-forming substrate corresponding to the at least two air pressure difference values, to obtain the intake of the aerosol-forming substrate within the set time period includes: calculating the intake of the aerosol-forming substrate by using the following formula: $\Delta m=c(\Sigma_{i=1}^{i=n}(aP+b))$, where $\Delta m$ is the intake of the aerosol-forming substrate, p is an air pressure difference value, a, b, and c are set parameters, a and b are associated with a power and the air pressure difference value of the electronic vaporization device, and c is associated with a type of the aerosol-forming substrate. The method further includes: obtaining the type of the aerosol-forming substrate; and determining the associated parameter c based on the type of aerosol-forming substrate.

The reminding a user according to the intake includes: reminding the user when the intake is greater than a preset intake threshold.

The adjusting operating parameters of the electronic vaporization device according to the intake includes: when the intake is greater than a preset intake threshold, stopping vaporization of a vaporization module in the electronic vaporization device or reducing a vaporization power of the vaporization module.

To resolve the foregoing technical problems, another technical solution used by this application is to provide an electronic vaporization device, including: an air pressure sensor, disposed in an airflow channel of the electronic vaporization device and configured to obtain an air pressure value in the airflow channel, the airflow channel being configured for vapor generated by the electronic vaporization device to flow for ease of inhaling, the vapor being generated through vaporization of an aerosol-forming substrate in the electronic vaporization device; and a processor, configured to calculate intake of the aerosol-forming substrate according to the air pressure value, and remind a user by controlling a corresponding reminding module according to the intake, or adjust operating parameters of the electronic vaporization device according to the intake.

The electronic vaporization device further includes a detection component configured to detect a type of the aerosol-forming substrate, and the processor is further configured to modify the intake of the aerosol-forming substrate according to the type of the aerosol-forming substrate.

To resolve the foregoing technical problems, another technical solution used by this application is to provide a computer storage medium, storing a computer program, the computer program, when executed by a processor, implementing the method described above.

The method for detecting intake of an aerosol-forming substrate provided in this application includes: obtaining an air pressure value in an airflow channel of an electronic vaporization device, the airflow channel being configured for vapor generated by the electronic vaporization device to flow for ease of inhaling, the vapor being generated through vaporization of an aerosol-forming substrate in the electronic vaporization device; calculating intake of the aerosol-forming substrate according to the air pressure value; and reminding a user according to the intake, or adjusting operating parameters of the electronic vaporization device according to the intake. According to the foregoing method, the air pressure value in the airflow channel of the electronic vaporization device is obtained, and the intake of the aerosol-forming substrate in the electronic vaporization device is accurately detected according to the air pressure value, so that inhaling intake of a user is controlled and the user is reminded.

The following clearly and completely describes technical solutions in embodiments of this application with reference to the accompanying drawings in the embodiments of this application. It may be understood that specific embodiments described herein are only used to explain this application, but not to limit this application. In addition, it should be further noted that, for ease of description, the accompanying drawings only show parts relevant to this application rather than the entire structure. All other embodiments obtained by a person of ordinary skill in the art based on the embodiments of this application without making creative efforts shall fall within the protection scope of this application.

In this application, the terms "include", "have", and any variant thereof are intended to cover a non-exclusive inclusion. For example, a process, method, system, product, or device that includes a series of steps or units is not limited to the listed steps or units, but further optionally includes a step or unit that is not listed, or further optionally includes another step or unit that is intrinsic to the process, method, product, or device.

Embodiment mentioned in this specification means that particular features, structures, or characteristics described with reference to the embodiment may be included in at least one embodiment of this application. The term appearing at different positions of this specification may not refer to the same embodiment or an independent or alternative embodiment that is mutually exclusive with another embodiment. A person skilled in the art explicitly or implicitly understands that the embodiments described in this specification may be combined with other embodiments.

Referring to FIG. 1, FIG. 1 is a schematic structural diagram of a first embodiment of an electronic vaporization device according to this application. The electronic vaporization device 10 includes an air pressure sensor 11, a processor 12, and a vaporization module 13. The processor 12 is connected to the air pressure sensor 11 and the vaporization module 13, to respectively control operation of the air pressure sensor 11 and the vaporization module 13.

The vaporization module 13 is configured to vaporize an aerosol-forming substrate (for example, tobaccos or e-liquid) to generate vapor, and a vaporization form may be pressure vaporization, electromagnetic vaporization, or ultrasonic vaporization, which is not specifically limited herein. An airflow channel 16 communicating the inside and the outside is disposed in the electronic vaporization device 10, and the generated vapor is inhaled from the airflow channel 16. It may be understood that, in this embodiment, intake of the aerosol-forming substrate is detected.

The air pressure sensor 11 is disposed in the airflow channel 16 and configured to obtain an air pressure value in the airflow channel 16, so that the processor 12 can obtain the air pressure value and calculate the intake of the aerosol-forming substrate based on the air pressure value.

Figure 2:
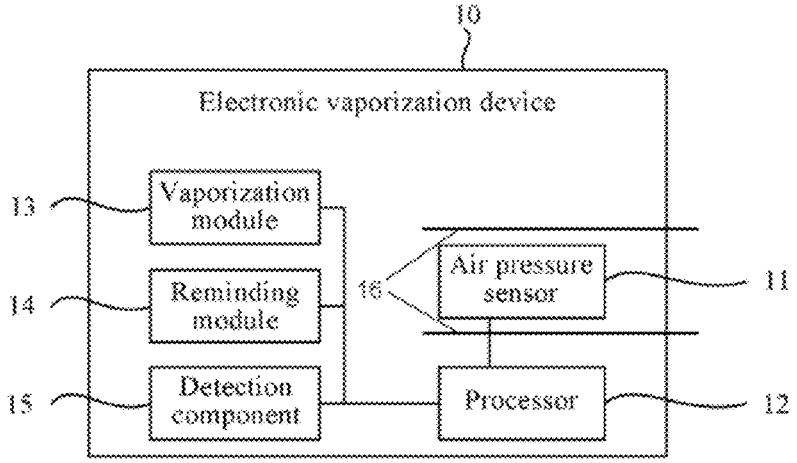
FIG. 2 is a schematic structural diagram of a second embodiment of an electronic vaporization device according to this application.

Referring to FIG. 2, FIG. 2 is a schematic structural diagram of a second embodiment of an electronic vaporization device according to this application.

Optionally, in an embodiment, the electronic vaporization device 10 further includes a reminding module 14 connected to the processor 12. The processor 12 is configured to calculate the intake of the aerosol-forming substrate according to the air pressure value in the airflow channel 16 obtained by the air pressure sensor 11, and control the corresponding reminding module 14 to remind a user according to the intake. For example, the reminding module 14 may be a speaker, a display screen, or an LED light. In an embodiment, the user may be reminded by using the reminding module 14 when the detected intake is greater than a preset threshold.

Optionally, in another embodiment, the processor 12 is further configured to adjust operating parameters of the electronic vaporization device 10 according to the intake. For example, the processor 12 may adjust a power, a temperature, or an operation time of the vaporization module 13 according to the intake.

Figure 3:
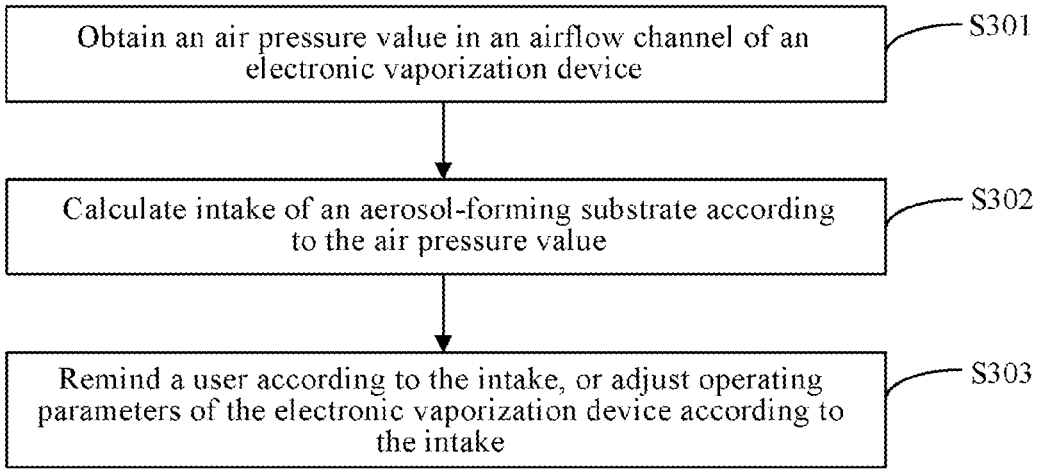
FIG. 3 is a schematic flowchart of a first embodiment of a method for detecting intake of an aerosol-forming substrate according to this application.

Optionally, in another embodiment, the electronic vaporization device 10 further includes a detection component 15 connected to the processor 12. The detection component 15 is configured to detect a type of the aerosol-forming substrate, namely, to recognize a specific type of the aerosol-forming substrate. Under the same inhaling force, intake brought by different types of aerosol-forming substrates are also different. Therefore, the intake of the aerosol-forming substrate obtained through calculation is modified by using the processor 12, to obtain more accurate intake. The detection component 15 may be a code scanner, and the aerosol-forming substrate may be solid-state tobaccos or liquid-state e-liquid, which is not required herein. The foregoing process may be described in detail in the following embodiments. Referring to FIG. 1, FIG. 2, and FIG. 3, FIG. 3 is a schematic flowchart of a first embodiment of a method for detecting intake of an aerosol-forming substrate according to this application. The method for detecting intake of an aerosol-forming substrate in this embodiment includes the following steps:

Step S301: Obtain an air pressure value in an airflow channel 16 of an electronic vaporization device.

After the vaporization module 13 starts working and generates vapor, the air pressure sensor 11 obtains an air pressure value in the airflow channel 16 of the electronic vaporization device 10. In an inhaling process of a user, the air pressure value in the airflow channel 16 of the electronic vaporization device 10 changes due to an inhale action of the user, so that the air pressure value is monitored in real time within a set time period. In this embodiment, the air pressure sensor 11 may be a pressure sensor, a venturi sensor, a pore plate, a Dall tube, an anemometer, a porous pressure probe, a cone flowmeter, or a turbine flowmeter.

Step S302: Calculate intake of an aerosol-forming substrate according to the air pressure value.

After the air pressure value in the airflow channel 16 is obtained by the air pressure sensor 11, a total amount of the aerosol-forming substrate inhaled by the user within a set time period is calculated according to the air pressure value. The set time period may be a time period in which the user completes one inhaling process, or may be a time period in which a plurality of inhaling processes are completed, which is not specifically limited. This process may be described in detail in the following embodiments.

Step S303: Remind a user according to the intake, or adjust operating parameters of the electronic vaporization device according to the intake.

According to the calculated total amount of the aerosol-forming substrate inhaled by the user within the set time period, when the intake meets a preset condition, the processor 12 controls the reminding module 14 to remind the user, or the processor 12 adjusts the power or the set time period of the electronic vaporization device 10 according to the total amount of the intake, to control the intake of the aerosol-forming substrate of the user.

The reminding module 14 may be a speaker, a display screen, an LED light, or a vibration motor, and the user is reminded of excessive inhaling intake and temperance is required by these components through prompt sound, displayed information, illumination, or vibration. The reminding module 14 may further be a mobile device such as a smart phone or a wearable smart device that is in a communication connection with the electronic vaporization device 10. The processor 12 may further generate information about the intake into a report and transmit the report to the foregoing mobile device, so that information such as an inhaling frequency within a time period of the user may be further viewed while the user is reminded.

In a specific embodiment, the preset condition may be reminding the user when the total amount of the intake is greater than an intake threshold. In another embodiment, the preset condition may alternatively be reminding the user when the intake is less than another intake threshold. In this case, content reminded to the user may be informing the user that the electronic vaporization device 10 may fail or a better level of the electronic vaporization device 10 is insufficient, so that the aerosol-forming substrate is reduced or the aerosol-forming substrate needs to be replaced.

Different from the related art, the method for detecting intake of an aerosol-forming substrate provided in this application includes: obtaining an air pressure value in an airflow channel of an electronic vaporization device; calculating intake of the aerosol-forming substrate according to the air pressure value; and reminding a user according to the intake, or adjusting operating parameters of the electronic vaporization device according to the intake. According to the foregoing method, the air pressure value in the airflow channel of the electronic vaporization device is obtained, and the intake of the aerosol-forming substrate in the electronic vaporization device is accurately detected according to the air pressure value, so that inhaling intake of a user is controlled and the user is reminded.

Figure 4:
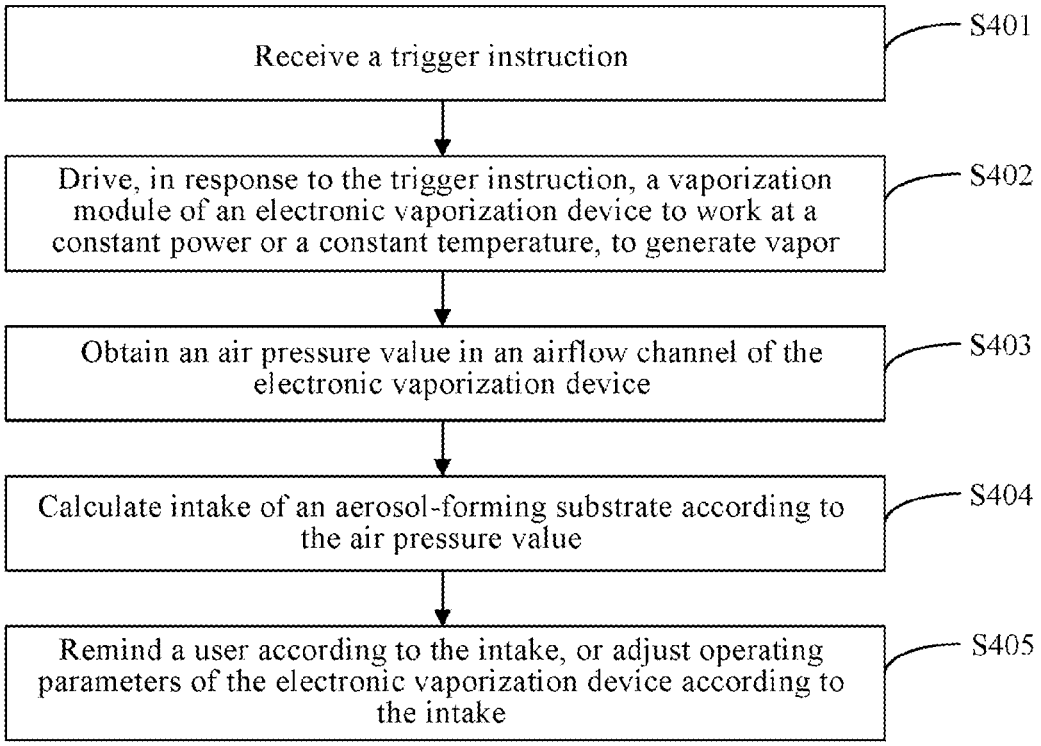
FIG. 4 is a schematic flowchart of a second embodiment of a method for detecting intake of an aerosol-forming substrate according to this application.

Referring to FIG. 1, FIG. 2, and FIG. 4, FIG. 4 is a schematic flowchart of a second embodiment of a method for detecting intake of an aerosol-forming substrate according to this application. The method for detecting intake of an aerosol-forming substrate in this embodiment includes the following steps:

Step S401: Receive a trigger instruction.

The processor 12 receives a trigger instruction transmitted by the user, and the trigger instruction may be a button trigger instruction, a touch trigger instruction, an inhale trigger instruction, or an action sensing trigger instruction.

The button trigger instruction and the touch trigger instruction may be implemented by using a specific button disposed outside the electronic vaporization device 10. When the user performs a press or touch action on the button, the button transmits a trigger instruction to the processor 12.

The inhale trigger instruction may be implemented by detecting whether the air pressure value in the airflow channel of the electronic vaporization device 10 changes by using the air pressure sensor 11. When the user performs an inhale action, the air pressure sensor 11 may change, and in this case, the air pressure sensor 11 transmits a trigger instruction to the processor 12.

The action sensing trigger instruction may be implemented by using a camera disposed outside the electronic vaporization device 10. A posture of the user is recognized by using the camera, for example, if the camera recognizes a slide or a gesture toward a direction, the camera transmits a trigger instruction to the processor 12.

Step S402: Drive, in response to the trigger instruction, a vaporization module of an electronic vaporization device to work at a constant power or a constant temperature, to generate vapor.

After the processor 12 receives the trigger instruction transmitted by the user, the vaporization module 13 of the electronic vaporization device 10 is driven to work at a constant power or a constant temperature to generate vapor, and the vapor is generated through vaporization of the aerosol-forming substrate in the electronic vaporization device.

In a use process of a common electronic vaporization device, the vaporized aerosol-forming substrate may not be completely inhaled by the user, and the intake of the aerosol-forming substrate inhaled by the user is generally affected by factors such as a power, a temperature, a type of the aerosol-forming substrate, an inhale time, and airflow pressure. Therefore, the electronic vaporization device 10 using a constant power or a constant temperature during outputted is required. In this case, amounts of aerosol-forming substrates generated by using the same electronic vaporization device 10 are basically the same.

Step S403: Obtain an air pressure value in an airflow channel of the electronic vaporization device.

After the vaporization module 13 starts working and generates vapor, the air pressure sensor 11 obtains an air pressure value in the airflow channel of the electronic vaporization device 10.

Optionally, in some embodiments, step S403 may further include: obtaining at least one real-time air pressure value in the airflow channel of the electronic vaporization device 10 within a set time period according to a set frequency.

The air pressure value in the airflow channel of the electronic vaporization device 10 may be increased or decreased due to an inhale action of the user, so that there are a plurality of different air pressure values within the set time period. The air pressure sensor 11 acquires the plurality of different actual air pressure values in the airflow channel in real time according to a certain set frequency. The set frequency may be 50 Hz to 100 Hz, namely, an interval time for obtaining different air pressure values is 10 milliseconds to 20 milliseconds. The set frequency is not specifically limited and may be adjusted according to the set time period.

Step S404: Calculate intake of an aerosol-forming substrate according to the air pressure value.

Step S405: Remind a user according to the intake, or adjust operating parameters of the electronic vaporization device according to the intake.

Optionally, in some embodiments, step S405 may further include: when a total amount of the intake is greater than a preset intake threshold, stopping vaporization of the vaporization module 13 in the electronic vaporization device 10 or reducing a vaporization power of the vaporization module 13.

Specific implementation steps of step S403 to step S405 are the same as those of the foregoing step S301 to step S303, and details are not described herein again.

Different from the related art, the method for detecting intake of an aerosol-forming substrate provided in this application includes: obtaining an air pressure value in an airflow channel of an electronic vaporization device; calculating intake of the aerosol-forming substrate according to the air pressure value; and reminding a user according to the intake, or adjusting operating parameters of the electronic vaporization device according to the intake. According to the foregoing method, the air pressure value in the airflow channel of the electronic vaporization device is obtained, and the intake of the aerosol-forming substrate in the electronic vaporization device is accurately detected according to the air pressure value, so that inhaling intake of a user is controlled and the user is reminded.

Figure 5:
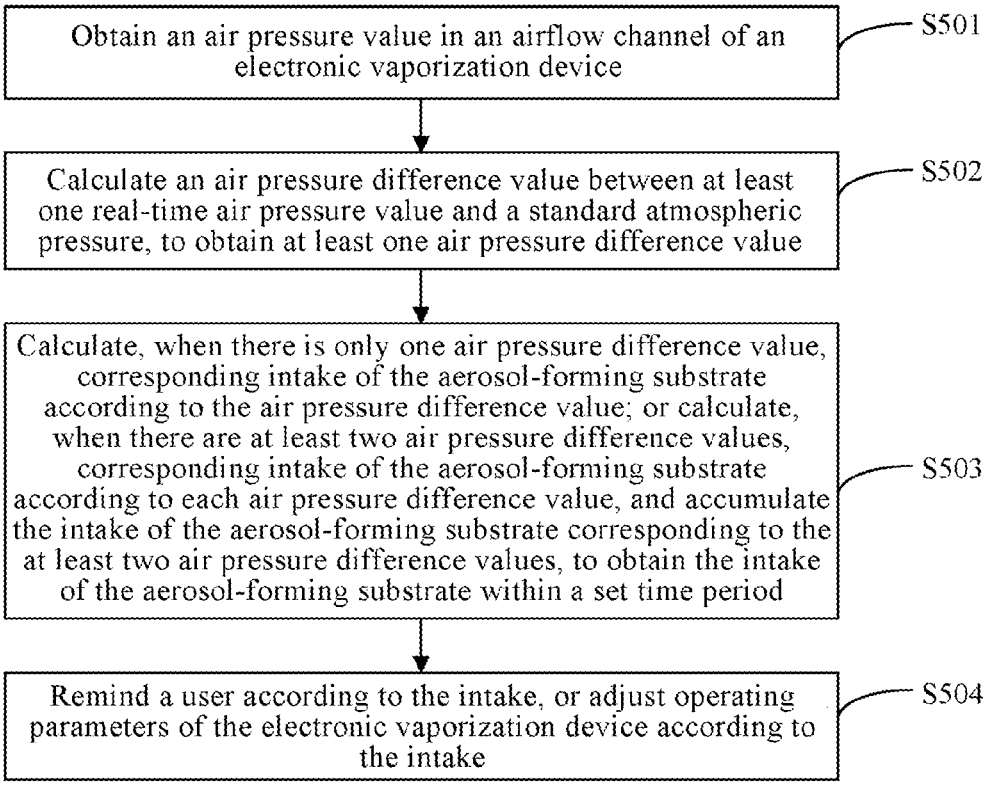
FIG. 5 is a schematic flowchart of a third embodiment of a method for detecting intake of an aerosol-forming substrate according to this application.

Referring to FIG. 1, FIG. 2, and FIG. 5, FIG. 5 is a schematic flowchart of a third embodiment of a method for detecting intake of an aerosol-forming substrate according to this application. The method for detecting intake of an aerosol-forming substrate in this embodiment includes the following steps:

Step S501: Obtain an air pressure value in an airflow channel of an electronic vaporization device.

After the vaporization module 13 starts working and generates vapor, the air pressure sensor 11 obtains a real-time air pressure value in the airflow channel of the electronic vaporization device 10 within a set time period according to a set frequency.

Step S502: Calculate an air pressure difference value between at least one real-time air pressure value and a standard atmospheric pressure, to obtain at least one air pressure difference value.

It may be understood that, when an inhale action within a set time period starts, the air pressure value in the airflow channel and the standard atmospheric pressure is the same (similar). As the inhale action starts, vapor in the airflow channel is inhaled, and the air pressure value in the airflow channel gradually decreases. When the inhale action stops, the air pressure value in the airflow channel reaches a minimum value, and the air pressure value then continues to rise. When the inhale action ends, the air pressure value in the airflow channel is restored to the standard atmospheric pressure, and such an inhale cycle is performed for a plurality of times. Therefore, in this step, after at least one real-time air pressure value in the airflow channel of the electronic vaporization device 10 within the set time period is obtained according to the set frequency, an air pressure difference value between each real-time air pressure value and the standard atmospheric pressure is calculated to obtain at least one air pressure difference value, so that total intake of the user within the set time period may be reflected.

Step S503: Calculate, when there is only one air pressure difference value, corresponding intake of an aerosol-forming substrate according to the air pressure difference value; or calculate, when there are at least two air pressure difference values, corresponding intake of the aerosol-forming substrate according to each air pressure difference value, and accumulate the intake of the aerosol-forming substrate corresponding to the at least two air pressure difference values, to obtain the intake of the aerosol-forming substrate within a set time period.

When there is only one air pressure difference value obtained through calculation, the intake of the aerosol-forming substrate within the set time period is directly calculated according to the air pressure difference value.

When there are at least two air pressure difference values obtained through calculation, after an air pressure difference value between one real-time air pressure value and the standard atmospheric pressure within the set time period is obtained, the intake of the aerosol-forming substrate inhaled by the user is calculated according to the air pressure difference value, and the intake of the aerosol-forming substrate corresponding to a plurality of air pressure difference values is accumulated, to obtain a total amount of the intake of the aerosol-forming substrate within the set time period.

The set time period may be a time period in which the user completes one inhale action, namely, a time period from the user transmits a trigger instruction to enable the vaporization module 13 to work to the end of the working. Alternatively, the set time period may be a specific quantity of inhale actions, for example, the set time period may be completion of 10 inhale actions. It should be noted that, air pressure difference values obtained by the 10 inhale actions is obtained by multiplying an inhale time by an air pressure sampling frequency, and there may be far more than 10 air pressure difference values. In addition, the set time period may start to time from a time when the electronic vaporization device 10 starts to work, a time period such as 5 minutes is preset, and intake of the aerosol-forming substrate corresponding to all real-time air pressure values within the 5 minutes is calculated.

In a specific embodiment, the intake of the aerosol-forming substrate may be calculated by using the following formula: $\Delta m=c(\Sigma_{i=1}^{i=n}(aP+b))$, and according to this formula, the total amount of the aerosol-forming substrate inhaled by the user within the set time period may be integrated. There may be one or a plurality of different air pressure values at the set frequency, so that the calculation accuracy of the intake of the aerosol-forming substrate may be improved.

When there is only one air pressure difference value obtained through calculation, n=1; Δm is the intake of the aerosol-forming substrate, namely, a total amount of the intake of the aerosol-forming substrate inhaled by the user within a set time period; p is the air pressure difference value, namely, an air pressure difference value between one real-time air pressure value and a standard atmospheric pressure at the set frequency; a, b, and c are set parameters, a and b are associated with the power and the air pressure difference value of the electronic vaporization device 10, when the electronic vaporization device works at a constant power or a constant temperature, a and b may change along with changes of the air pressure value in the airflow channel of the electronic vaporization device 10, and a and b may be the same or may be different under different air pressures; and c is associated with a type of the aerosol-forming substrate, and the type of the aerosol-forming substrate may be recognized by using the detection component 15 to obtain the set parameter c.

Figure 6:
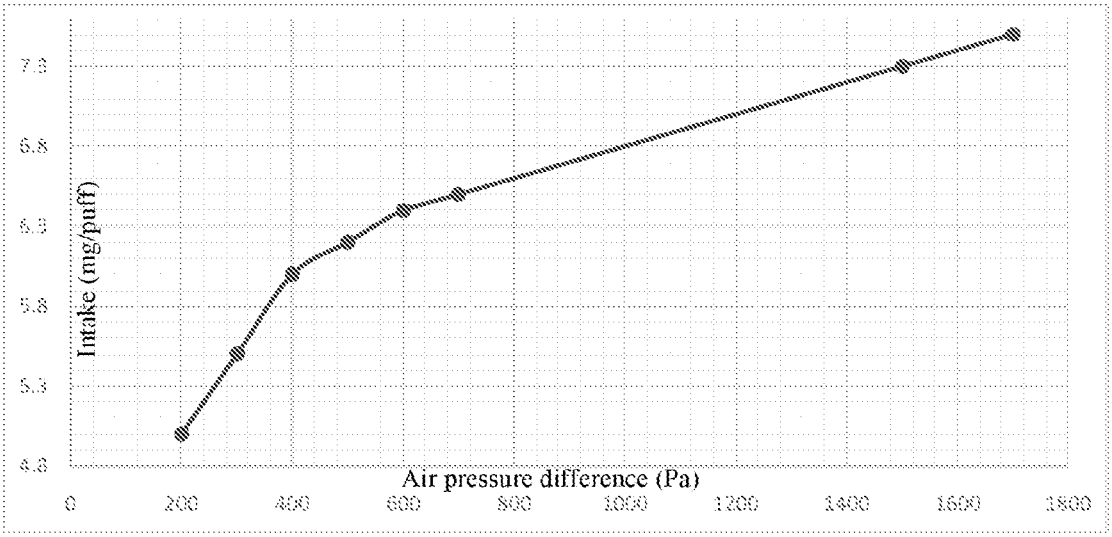
FIG. 6 is a schematic diagram of a curve according to this application.

In this formula, there is a deterministic relationship between the intake Δm of the aerosol-forming substrate and the air pressure difference value p, and an approximate curve of the relationship is shown in FIG. 6. From the perspective of the entire image, the intake Δm of the aerosol-forming substrate increases as the air pressure difference value p increases, and in different air pressure difference value ranges, amplitudes increased by the intake Δm may be different. For example, in a range from 200 Pa to 400 Pa of the air pressure difference value p, as the air pressure difference value p increases, an increase amplitude of the intake Δm is much greater than increase amplitudes in other air pressure difference value ranges. Calculation may be performed according to the formula in an entire air pressure range or may be performed segment by segment, for example, 0 to 100 Pa corresponds to one curve, 100 Pa to 200 Pa corresponds to another curve, and the rest may be deduced by analogy.

Optionally, in some embodiments, the detection method in this application may further include: obtaining a type of the aerosol-forming substrate; and determining the associated parameter c based on the type of aerosol-forming substrate.

The electronic vaporization device 10 includes a cartridge. The cartridge is in a detachable connection to help the user to replace e-liquid, namely, the aerosol-forming substrate. Different types of aerosol-forming substrates may produce different aerosol-forming substrates, a cartridge of each type of aerosol-forming substrate has a unique identifier, and the identifier may be an image or a chip such as two-dimensional code or bar code that can be recognized, to represent different types of aerosol-forming substrates. The detection component 15 stores information including types of aerosol-forming substrates in advance, and the detection component 15 obtains the type of aerosol-forming substrate by recognizing the identifier on the cartridge. The processor 12 determines the associated parameter c in the foregoing formula according to the type of the aerosol-forming substrate.

The following table shows values obtained by performing actual tests according to the foregoing formula, and as can be seen from the data, the accuracy can meet most applications.

| Calculated intake | Actual intake | Error |
|---|---|---|
| 164.507 | 163.9 | 0.4% |
| 169.158 | 166.2 | 1.8% |
| 182.107 | 185.5 | −1.8% |
| 170.095 | 170.4 | −0.2% |
| 168.863 | 176.2 | −4.2% |
| 178.046 | 168.9 | 5.4% |
| 177.516 | 171.8 | 3.3% |
| 164.154 | 159.1 | 3.2% |
| 168.435 | 158.1 | 6.5% |
| 142.971 | 146.8 | −2.6% |
| 180.065 | 187.2 | −3.8% |
| 175.613 | 183.8 | −4.5% |
| 167.66 | 174.6 | −4.0% |
| 167.214 | 179.2 | −6.7% |
| 161.284 | 168 | −4.0% |
| 179.007 | 176.1 | 1.7% |
| 165.477 | 166.6 | −0.7% |
| 154.25 | 150.8 | 2.3% |
| 154.24 | 158.4 | −2.6% |
| 138.532 | 147.4 | −6.0% |
| 162.585 | 163.1 | −0.3% |
| 178.974 | 180.6 | −0.9% |
| 176.088 | 181 | −2.7% |
| 166.049 | 168.8 | −1.6% |
| 173.894 | 173.8 | 0.1% |
| 176.241 | 168.4 | 4.7% |
| 170.076 | 161 | 5.6% |
| 163.057 | 155.5 | 4.9% |
| 167.432 | 163.5 | 2.4% |
| 149.43 | 156.4 | −4.5% |
| 179.368 | 190.7 | −5.9% |
| 180.462 | 193.5 | −6.7% |
| 173.537 | 182.4 | −4.9% |
| 166.707 | 178.3 | −6.5% |
| 157.008 | 168.8 | −7.0% |
| 175.657 | 166.4 | 5.6% |
| 163.017 | 153.7 | 6.1% |
| 161.178 | 160.8 | 0.2% |
| 155.789 | 157.1 | −0.8% |
| 138.538 | 148.3 | −6.6% |
| 183.109 | 192 | −4.6% |
| 191.917 | 196.3 | −2.2% |
| 187.965 | 196.8 | −4.5% |
| 170.719 | 179.6 | −4.9% |
| 154.283 | 161.8 | −4.6% |
| 179.682 | 180.1 | −0.2% |
| 177.159 | 177.3 | −0.1% |
| 169.743 | 173.5 | −2.2% |
| 166.269 | 171.2 | −2.9% |
| 158.997 | 159.9 | −0.6% |
| 177.559 | 190.3 | −6.7% |
| 180.15 | 193.5 | −6.9% |
| 178.26 | 189.1 | −5.7% |
| 158.989 | 169.8 | −6.4% |
| 149.142 | 160 | −6.8% |
| 175.771 | 180.6 | −2.7% |
| 172.123 | 174 | −1.1% |
| 174.225 | 179.5 | −2.9% |
| 141.08 | 145.4 | −3.0% |
| 133.831 | 135.6 | −1.3% |
| 181.939 | 189.9 | −4.2% |
| 193.775 | 193.3 | 0.2% |
| 186.299 | 189.2 | −1.5% |

-continued

| Calculated intake | Actual intake | Error |
|---|---|---|
| 171.366 | 176.5 | −2.9% |
| 146.809 | 153.7 | −4.5% |
| 173.335 | 160.8 | 7.8% |
| 174.455 | 163.2 | 6.9% |
| 169.287 | 158.4 | 6.9% |
| 171.557 | 169.8 | 1.0% |
| 155.919 | 157 | −0.7% |
| 183.536 | 196.7 | −6.7% |
| 178.214 | 190.1 | −6.3% |
| 180.727 | 193.5 | −6.6% |
| 164.512 | 170.8 | −3.7% |
| 152.47 | 162.6 | −6.2% |
| 173.433 | 170.2 | 1.9% |
| 174.868 | 174.5 | 0.2% |
| 171.379 | 173.8 | −1.4% |
| 152.303 | 146.4 | 4.0% |
| 135.573 | 131.4 | 3.2% |

Step S504: Remind a user according to the intake, or adjust operating parameters of the electronic vaporization device according to the intake.

A specific implementation of step S504 is the same as that of step S303, and details are not described herein again. Different from the related art, the method for detecting intake of an aerosol-forming substrate provided in this application includes: obtaining an air pressure value in an airflow channel of an electronic vaporization device; calculating intake of the aerosol-forming substrate according to the air pressure value; and reminding a user according to the intake, or adjusting operating parameters of the electronic vaporization device according to the intake. According to the foregoing method, the air pressure value in the airflow channel of the electronic vaporization device is obtained, and the intake of the aerosol-forming substrate in the electronic vaporization device is accurately detected according to the air pressure value, so that inhaling intake of a user is controlled and the user is reminded.

Figure 7:
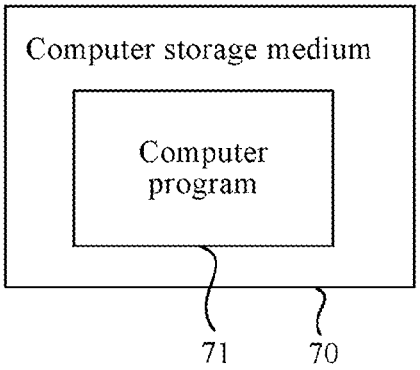
FIG. 7 is a schematic structural diagram of a computer storage medium according to an embodiment of this application.

Referring to FIG. 7, FIG. 7 is a schematic structural diagram of a computer storage medium according to an embodiment of this application. The computer storage medium 70 stores a computer program 71, and the computer program 71, when executed by the processor 12, is configured to implement the following method:

obtaining an air pressure value in an airflow channel of an electronic vaporization device, the airflow channel being configured for vapor generated by the electronic vaporization device to flow for ease of inhaling, the vapor being generated through vaporization of an aerosol-forming substrate in the electronic vaporization device; calculating intake of the aerosol-forming substrate according to the air pressure value; and reminding a user according to the intake, or adjusting operating parameters of the electronic vaporization device according to the intake.

Optionally, in another embodiment, the computer program, when executed by the processor, is further configured to implement the following method: receiving a trigger instruction; and driving, in response to the trigger instruction, a vaporization module of the electronic vaporization device to work at a constant power or a constant temperature, to generate the vapor.

Optionally, in another embodiment, the computer program, when executed by the processor, is further configured to implement the following method: obtaining at least one real-time air pressure value in the airflow channel of the electronic vaporization device within a set time period according to a set frequency; calculating an air pressure difference value between the at least one real-time air pressure value and a standard atmospheric pressure, to obtain at least one air pressure difference value; calculating, when there is only one air pressure difference value, corresponding intake of the aerosol-forming substrate according to the air pressure difference value; or calculating, when there are at least two air pressure difference values, corresponding intake of the aerosol-forming substrate according to each air pressure difference value, and accumulating the intake of the aerosol-forming substrate corresponding to the at least two air pressure difference values, to obtain the intake of the aerosol-forming substrate within the set time period.

Optionally, in another embodiment, the computer program, when executed by the processor, is further configured to implement the following method: calculating the intake of the aerosol-forming substrate by using the following formula: $\Delta m=c(\Sigma_{i=1}^{i=n}(aP+b))$, where $\Delta m$ is the intake of the aerosol-forming substrate, p is an air pressure difference value, a, b, and c are set parameters, a and b are associated with a power and the air pressure difference value of the electronic vaporization device, and c is associated with a type of the aerosol-forming substrate.

Optionally, calculation of the intake of the aerosol-forming substrate may be performed by using a linear calculation method, a table lookup method, a power function method, a logarithmic function method, or a linear calculation and compensation method.

This solution is intended to find a differential relationship between the intake of the aerosol-forming substrate and an inhale pressure difference. The relationship is $m=f(p)$ if represented by using a mathematical function, where m is the intake of the aerosol-forming substrate, p is the inhale pressure difference, and the function may be calculated based on theory or based on experience. Optionally, in another embodiment, the computer program, when executed by the processor, is further configured to implement the following method: obtaining a type of the aerosol-forming substrate; and determining the associated parameter c based on the type of aerosol-forming substrate.

Optionally, in another embodiment, the computer program, when executed by the processor, is further configured to implement the following method: reminding a user when the intake is greater than a preset intake threshold.

Optionally, in another embodiment, the computer program, when executed by the processor, is further configured to implement the following method: when the intake is greater than a preset intake threshold, stopping vaporization of a vaporization module in the electronic vaporization device or reducing a vaporization power of the vaporization module.

In the several implementations provided in this application, it should be understood that the disclosed method and device may be implemented in other manners. For example, the described device embodiment is merely exemplary. For example, the division of the modules or units is merely a logical function division and may be other division during actual implementation. For example, a plurality of units or components may be combined or integrated into another system, or some features may be ignored or not performed.

The units described as separate components may or may not be physically separated, and the components displayed as units may or may not be physical units, and may be located in one place or may be distributed over a plurality of network units. Some or all of the units may be selected according to actual requirements to achieve the objectives of the solutions of the implementations.

In addition, functional units in the implementations of this application may be integrated into one processing unit, or each of the units may exist alone physically, or two or more units may be integrated into one unit. The integrated unit may be implemented in the form of hardware, or may be implemented in a form of a software functional unit.

When the integrated unit in other implementations is implemented in the form of a software functional unit and sold or used as an independent product, the integrated unit may be stored in a computer-readable storage medium. Based on such an understanding, the technical solutions of this application essentially, or the part contributing to the related art, or all or some of the technical solutions may be implemented in the form of a software product. The computer software product is stored in a storage medium and includes several instructions for instructing a computer device (which may be a personal computer, a server, a network device, or the like) or a processor to perform all or some of the steps of the methods described in the implementations of this application. The foregoing storage medium includes: any medium that can store program code, such as a USB flash disk, a removable hard disk, a read-only memory (ROM), a random access memory (RAM), a magnetic disk, or an optical disc.

The foregoing descriptions are merely implementations of this application, and the protection scope of this application is not limited thereto. All equivalent structure or process changes made according to the content of this specification and accompanying drawings in this application or by directly or indirectly applying this application in other related technical fields shall fall within the protection scope of this application.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A detection method for detecting intake of an aerosol-forming substrate, applicable to an electronic vaporization device, the detection method comprising:

obtaining an air pressure value in an airflow channel of the electronic vaporization device, the airflow channel being configured to flow vapor generated by the electronic vaporization device for ease of inhaling, the vapor being generated through vaporization of an aerosol-forming substrate in the electronic vaporization device;

calculating intake of the aerosol-forming substrate according to the air pressure value; and reminding a user according to the intake, or adjusting operating parameters of the electronic vaporization device according to the intake.

2. The detection method of claim 1, wherein before the obtaining the air pressure value in the airflow channel of the electronic vaporization device, the method further comprises:

receiving a trigger instruction; and driving, in response to the trigger instruction, a vaporization module of the electronic vaporization device to work at a constant power or a constant temperature, to generate the vapor.

3. The detection method of claim 1, wherein the obtaining the air pressure value in the airflow channel of the electronic vaporization device comprises obtaining at least one real-time air pressure value in the airflow channel of the electronic vaporization device within a set time period according to a set frequency, and wherein the calculating intake of the aerosol-forming substrate according to the air pressure value comprises:

calculating an air pressure difference value between the at least one real-time air pressure value and a standard atmospheric pressure, to obtain at least one air pressure difference value; and calculating, when there is only one air pressure difference value, corresponding intake of the aerosol-forming substrate according to the air pressure difference value, or calculating, when there are at least two air pressure difference values, corresponding intake of the aerosol-forming substrate according to each air pressure difference value, and accumulating the intake of the aerosol-forming substrate corresponding to the at least two air pressure difference values, to obtain the intake of the aerosol-forming substrate within the set time period.

4. The detection method of claim 3, wherein the calculating corresponding intake of the aerosol-forming substrate according to each air pressure difference value and accumulating the intake of the aerosol-forming substrate corresponding to the at least two air pressure difference values, to obtain the intake of the aerosol-forming substrate within the set time period comprises:

calculating the intake of the aerosol-forming substrate by using the following formula:

$$\Delta m = c\left(\Sigma_{i=1}^{i=n}(aP+b)\right)$$

wherein Δm is the intake of the aerosol-forming substrate; p is the air pressure difference value; a, b, and c are set parameters; a and b are associated with a power and the air pressure difference value of the electronic vaporization device; and c is associated with a type of the aerosol-forming substrate.

5. The detection method of claim 4, further comprising:

obtaining the type of the aerosol-forming substrate; and determining associated parameter c based on the type of aerosol-forming substrate.

6. The detection method of claim 1, wherein the reminding the user according to the intake comprises:

reminding the user when the intake is greater than a preset intake threshold.

7. The detection method of claim 1, wherein the adjusting operating parameters of the electronic vaporization device according to the intake comprises:

when the intake is greater than a preset intake threshold, stopping vaporization of a vaporization module in the electronic vaporization device or reducing a vaporization power of the vaporization module.

8. An electronic vaporization device, comprising:

an airflow channel configured to flow vapor generated by the electronic vaporization device for ease of inhaling, the vapor being generated through vaporization of an aerosol-forming substrate in the electronic vaporization device;

an air pressure sensor, disposed in the airflow channel, the air pressure sensor being configured to obtain an air pressure value in the airflow channel; and a processor configured to calculate intake of the aerosol-forming substrate according to the air pressure value, and remind a user by controlling a corresponding reminding module according to the intake, or adjust operating parameters of the electronic vaporization device according to the intake.

9. The electronic vaporization device of claim 8, further comprising:

a detection component configured to detect a type of the aerosol-forming substrate, wherein the processor is configured to modify the intake of the aerosol-forming substrate according to the type of the aerosol-forming substrate.

10. One or more non-transitory computer-readable mediums having processor-executable instructions stored thereon, wherein the processor-executable instructions, when executed, facilitate the detection method of claim 1.

* * * * *